US010811752B2

(12) United States Patent
Hashemi-Yeganeh et al.

(10) Patent No.: US 10,811,752 B2
(45) Date of Patent: Oct. 20, 2020

(54) OFFSET BLOCK WAVEGUIDE COUPLER

(71) Applicant: ThinKom Solutions, Inc., Hawthorne, CA (US)

(72) Inventors: Shahrokh Hashemi-Yeganeh, Rancho Palos Verdes, CA (US); William Milroy, Torrance, CA (US)

(73) Assignee: ThinKom Solutions, Inc., Hawthorne, CA (US)

( * ) Notice: Subject to any disclaimer, the term of this patent is extended or adjusted under 35 U.S.C. 154(b) by 0 days.

(21) Appl. No.: 16/354,284

(22) Filed: Mar. 15, 2019

(65) Prior Publication Data

US 2020/0295431 A1 Sep. 17, 2020

(51) Int. Cl.

| | |
|---|---|
| ***H01P 5/02*** | (2006.01) |
| ***H01Q 19/13*** | (2006.01) |
| ***H01Q 21/00*** | (2006.01) |
| ***H01P 1/02*** | (2006.01) |

(52) U.S. Cl.

CPC ..... *H01P 5/024* (2013.01); *H01P 1/025* (2013.01); *H01P 1/027* (2013.01); *H01Q 19/138* (2013.01); *H01Q 21/0043* (2013.01)

(58) Field of Classification Search

CPC ..... H01P 5/024; H01P 1/025; H01P 1/027; H01Q 21/0043

USPC ..... 333/34

See application file for complete search history.

(56) References Cited

U.S. PATENT DOCUMENTS

| | | | | |
|---|---|---|---|---|
| 2,649,576 | A | 8/1953 | Lewis | |
| 7,148,765 | B2 * | 12/2006 | Tahara | H01P 5/107 333/26 |
| 7,218,801 | B2 | 5/2007 | Chambelin et al. | |
| 2004/0119554 | A1 * | 6/2004 | Tahara | H01P 5/107 333/26 |
| 2009/0237184 | A1 | 9/2009 | Sarasa | |
| 2013/0141186 | A1 | 6/2013 | Nguyen et al. | |
| 2015/0123862 | A1 * | 5/2015 | Milroy | H01Q 19/138 343/776 |
| 2019/0393577 | A1 * | 12/2019 | Milroy | H01P 1/025 |

OTHER PUBLICATIONS

European Search Report and Search Opinion issued in connection with corresponding EP 20162276, dated Jul. 16, 2020.

* cited by examiner

*Primary Examiner* — Robert J Pascal
*Assistant Examiner* — Kimberly E Glenn
(74) *Attorney, Agent, or Firm* — Kusner & Jaffe

(57) ABSTRACT

A waveguide coupler includes a waveguide having a first and a second port, and a slot formed in a broadwall of the waveguide between the first and second ports, the slot centered on the first broadwall. A plurality of shifted waveguide sections are arranged between the first and second ports and extend along a length of the waveguide. A parallel-plate transmission line structure is coupled to the slot, wherein RF signals within one of the waveguide or the parallel-plate transmission line are communicated to the other of the waveguide and the parallel-plate transmission line through the slot.

20 Claims, 7 Drawing Sheets

OFFSET BLOCK WAVEGUIDE COUPLER

TECHNICAL FIELD

The present invention relates generally to waveguides and, more particularly, to a waveguide coupler that efficiently launches a desired uniform or non-uniform Radio Frequency (RF) field-distribution into an open parallel-plate transmission line structure.

BACKGROUND ART

Multiple techniques have been employed to couple a waveguide into a parallel-plate transmission line that is multiple wavelengths in width. These techniques include, for example, direct open-ended waveguide-to-parallel-plate interfaces, indirect slot-coupled waveguide-to-parallel-plate interfaces, direct coax-to-parallel-plate interfaces, and horn feeds.

Direct open-ended waveguide-to-parallel-plate interfaces tend to be bulky and have grating-lobe related limits on maximum spacing. They also require separate corporate or traveling-wave feed for excitation and can be relatively expensive and difficult to realize in practical injection-molded structures. Examples of direct open-ended waveguide-to-parallel-plate interfaces include an array of open-ended rectangular or ridged waveguides (E-plane aligned), and an array of open-ended rectangular or ridged waveguides (with 90 degree twists).

Indirect slot-coupled waveguide-to-parallel-plate interfaces also are bulky and often have limited bandwidth due to the resonant properties of the requisite coupling slot. They also are difficult to realize in practical injection-molded structures. Further, some grating-lobe limitations exist for maximum spacing and for potential higher-order mode excitation in some slot excitation geometries. Examples of indirect waveguide-to-parallel-plate interfaces include a common-broadwall (series-series, shunt-series) coupling.

Direct coax-to-parallel-plate interfaces are bulky with grating-lobe related limits on maximum interelement spacing and require a separate corporate or traveling-wave feed for excitation.

Horn-feeds, like the other techniques, also are bulky and have limits on excitation phase and amplitude control.

SUMMARY OF INVENTION

In view of the aforementioned shortcomings of currently available methods for coupling a waveguide into a parallel-plate transmission line, a device and method in accordance with the present invention efficiently feed a desired uniform or non-uniform radio frequency (RF) field-distribution into an open parallel-plate transmission line. More specifically, controlled coupling of energy is performed via a centered continuous slot opening in a wall of the waveguide that connects one or both broadwall(s) of a rectangular waveguide to an adjoining parallel-plate transmission line, where a plurality of stepped sections extend along a length of the waveguide and create a controlled coupling through the continuous-centered slot. When compared to conventional methods, the device and method in accordance with the invention provide superior excitation control, superior physical compactness, broader operating frequency bandwidth capability, enhanced design flexibility, and superior tolerance insensitivity/producibility.

According to one aspect of the invention, a waveguide coupler includes: a waveguide including a first and a second port; a first slot formed in a first broadwall of the waveguide between the first and second ports, the first slot centered on the first broadwall; a plurality of shifted waveguide sections arranged between the first and second ports and extending along a length of the waveguide; and a first parallel-plate transmission line structure coupled to the first slot, wherein RF signals within one of the waveguide or the parallel-plate transmission line are communicated to the other of the waveguide or the parallel-plate transmission line through the slot.

In one embodiment, each shifted waveguide section includes an alternating arrangement of ascending or descending steps.

In one embodiment, the alternating arrangement of ascending or descending steps is formed at least partially on sidewalls of the waveguide, and each step on a first sidewall of the waveguide is offset along a length of the waveguide from a step on a second sidewall of the waveguide, the second sidewall opposite the first sidewall.

In one embodiment, each shifted waveguide section comprises at least one step having a step width and a step height, and each step of the plurality of shifted waveguide sections has the same step width and step height as other steps of the plurality of shifted waveguide sections.

In one embodiment, each shifted waveguide section comprises at least one step having a step width and a step height, and at least one step of the plurality of shifted waveguide sections has a different step width or step height from other steps of the plurality of shifted waveguide sections.

In one embodiment, the step width corresponds to a quarter wavelength of an RF signal propagating through the waveguide.

In one embodiment, the waveguide a-dimension of the waveguide coupler is constant throughout.

In one embodiment, the plurality of shifted waveguide sections approximate a sinusoidal profile in the waveguide coupler.

In one embodiment, the waveguide a-dimension of the waveguide coupler varies.

In one embodiment, the second port comprises a load that attenuates an RF signal propagating in the waveguide.

In one embodiment, the second port comprises a short that electrically connects the first sidewall to the second sidewall.

In one embodiment, the waveguide coupler comprises a dielectric material.

In one embodiment, the dielectric material comprises one of a solid dielectric or an air dielectric.

In one embodiment, the waveguide coupler includes a plurality of tuner features formed in at least one of the first broadwall or a second broadwall of the waveguide.

In one embodiment, the tuner features are at least partially formed in at least one of the shifted waveguide sections.

In one embodiment, the waveguide coupler includes a second slot formed a second broadwall of the waveguide, the second broadwall arranged opposite the first broadwall.

In one embodiment, the waveguide coupler includes a second parallel-plate transmission line structure coupled to the second slot to communicate RF signals between the waveguide and the parallel plate transmission line.

In one embodiment, each port comprises an electrical short circuit, further comprising a plurality of input waveguides coupled to a second broadwall of the waveguide, wherein at least one shifted waveguide section of the plurality of shifted waveguide sections is arranged between adjacent input waveguides.

In one embodiment, virtual shorts are formed at boundaries between adjacent input waveguides.

According to another aspect of the invention, a method is provided for launching a desired uniform or non-uniform Radio Frequency (RF) field-distribution from a waveguide into an open parallel-plate transmission line structure, wherein the waveguide is coupled to the parallel-plate transmission line via a continuous slot centered in a broadwall of the waveguide. The method includes using shifted waveguide sections in the waveguide to perturb the RF field distribution in such a way as to couple RF energy via the continuous slot in order to create a desired e-field distribution in the parallel-plate section.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features.

DETAILED DESCRIPTION OF INVENTION

Figure 1A:
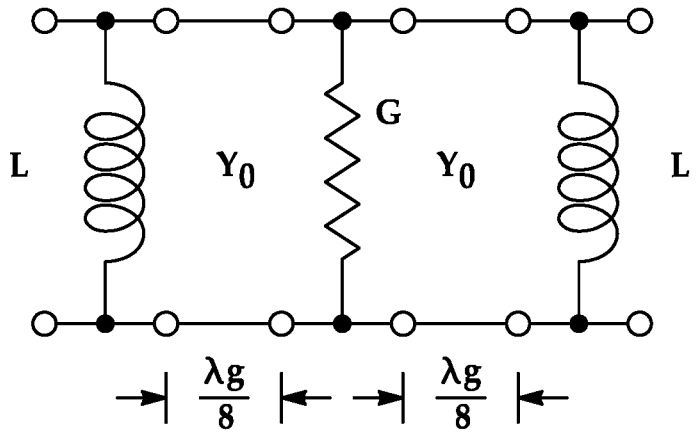
FIGS. 1A and 1B are schematic diagrams of equivalent circuits for shifted waveguide sections in accordance with the invention.

For RF antenna applications it is desirable to create controlled amplitude and phase distributions ("aperture excitations") in order to meet specific antenna gain, sidelobe, beamwidth, and overall antenna pattern ("RF radiation") design characteristics. For direct-radiating array antennas employing parallel-plate transmission lines, this implies the need for efficient launching (from a single waveguide interface, the "input/output" port of the antenna) of controlled transverse electric (TE) parallel-plate waveguide "modes" that are bounded and propagating within the parallel-plate structure.

As used herein, a parallel-plate transmission line is defined as an RF transmission line that includes two generally parallel conductive plates (two or more wavelengths in width and one or more wavelengths in length) separated by a predetermined distance (generally less than ½ wavelength) from one another.

In a conventional waveguide feed, a linear array of discrete resonant slots are offset various distances from a center line of the common broadwall of a waveguide (line-feed) in order to provide the desired coupling characteristic (individual slot coupling values) such that a specific phase and amplitude distribution (and requisite power-to-load) is realized. Such conventional device exhibits limited bandwidth capability, largely due to the classical (undesirable) variation in "real" (G) and "reactive" (jB) coupling components of the resonant coupling slots as operating frequency moves away from the design center frequency (fo).

In contrast, the device and method in accordance with the present invention employ novel periodic or pseudo-periodic waveguide sidewall and broadwall features incorporated into a single straight rectangular waveguide "feed" adjoining the parallel-plate transmission line. A pseudo-periodic waveguide is generally within 10 percent of a strictly periodic structure, i.e., features are separated from one another by a fixed distance or by a distance that varies within ±10 percent of a fixed distance. The features excite ("launch") desired parallel-plate modes consistent with realization of a desired aperture excitation and thereby the desired RF antenna characteristics. Further, the device and method in accordance with the invention employ a continuous centered slot along the broadwall centerline of the waveguide line-feed, forming a (reduced height) intermediate parallel-plate region (e.g., a "fin") which is subsequently coupled/transitioned into a (increased height) parallel-plate transmission-line section.

In its simplest basic "offset block" (OSB) embodiment (also referred to as a shifted waveguide embodiment), the sidewalls of the waveguide are "offset" as constant-width "blocks" (waveguide sections) in order to control local coupling from the waveguide line feed into the parallel-plate region. These shifted waveguide sections are typically one-quarter guide-wavelength in length and longitudinally separated by one-half guide wavelength (inter-element spacing), with individual shifted waveguide sections alternating in offset direction in synchronicity with the internal waveguide fields (broadwall current patterns) associated with the dominant TE10 propagating modes.

Referring initially to FIG. 1A, a simplified equivalent circuit is shown with the coupled power (coupled from the waveguide into the parallel-plate) represented as a shunt conductance (G) and the reflections and phase shift associated with RF fringing at each edge of the shifted waveguide section represented as shunt inductances, each offset ⅛ of a wavelength from the centerline of the section.

Figure 1B:
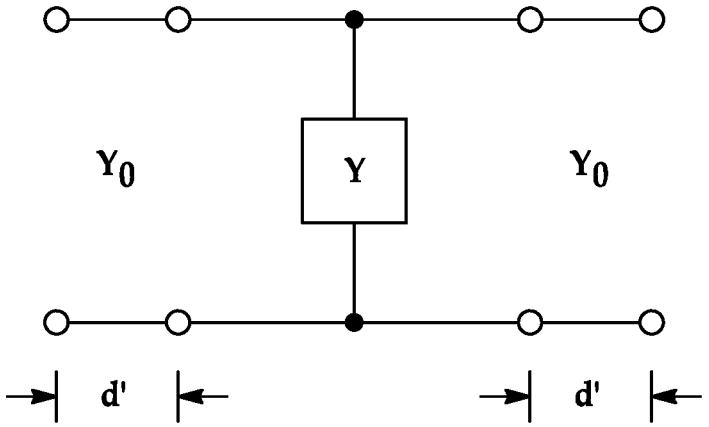

As a result of the individual shifted waveguide section's (typical) ¼-wavelength, the reactive components at leading and lagging edges cancel leaving (predominantly at "resonance") a matched pseudo-constant coupling (modeled via the shunt conductance) as a function of waveguide offset. Referring to FIG. 1B, a more generalized equivalent circuit model for the individual shifted waveguide is a shunt admittance (Y) with short transmission-line sections of length d' on either end in order to "model" the phase-shift associated with the inductive fringing at the abrupt shifted waveguide transitions. Resonance is defined as when the shunt admittance is pure real, the insertion phase (unlike a typical slot) has residual positive phase component (as modeled by the short transmission line sections).

Figure 2:
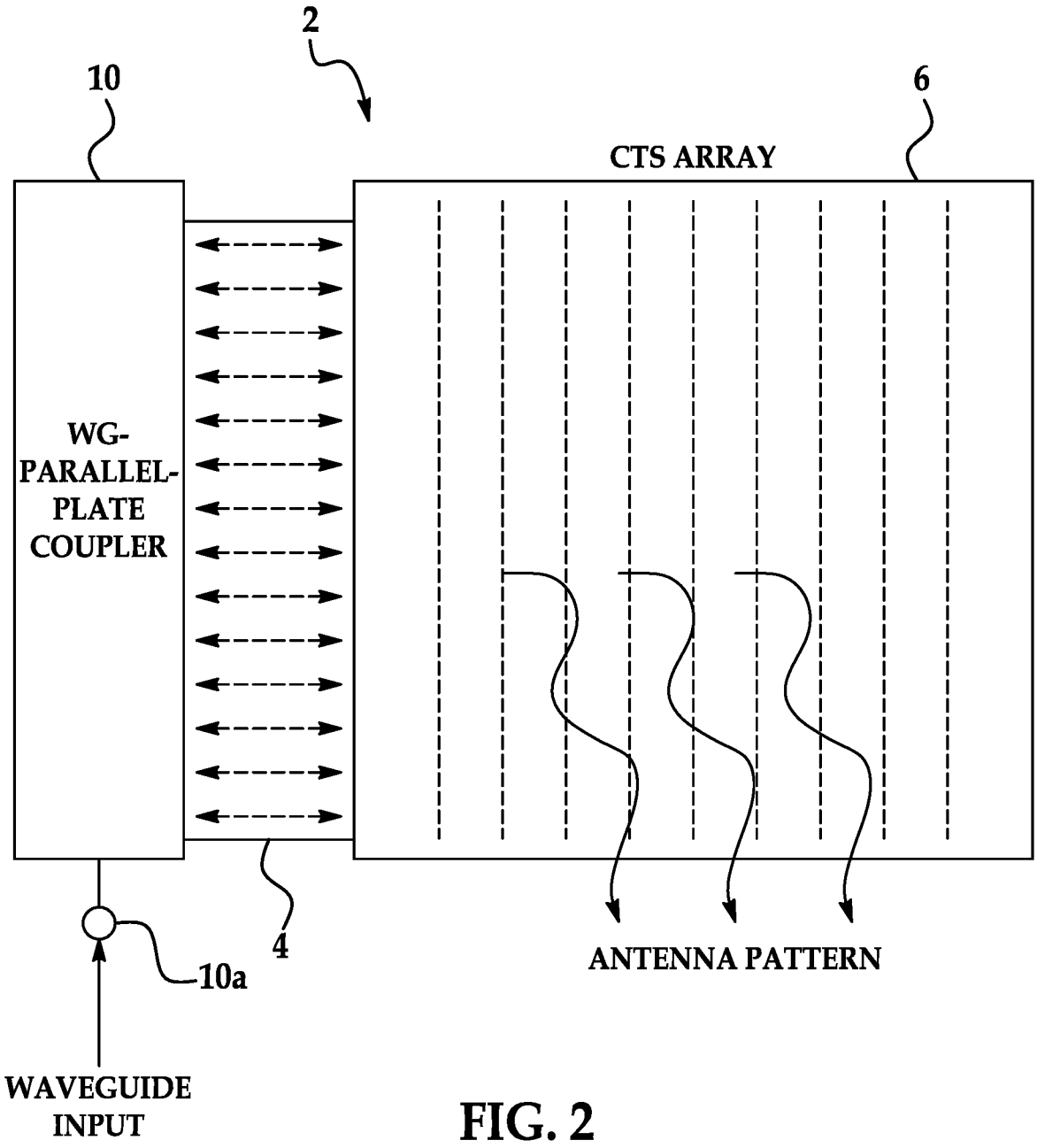
FIG. 2 illustrates an exemplary antenna system that utilizes a waveguide coupler in accordance with the present invention.

With reference to FIG. 2, illustrated is an exemplary system 2 implementing waveguide coupler 10 in accordance with the present invention. In addition to the waveguide coupler 10, the system 2 includes a parallel-plate transmission line 4 communicatively connected to the coupler 10, and an antenna array 6 (e.g., a continuous transverse stub (CTS) array) coupled to the parallel-plate transmission line 4. RF signals enter the waveguide coupler 10 via a waveguide input 10*a*, are communicated to the parallel-plate transmission line 4 and radiated by the antenna array 6.

Figure 3A:
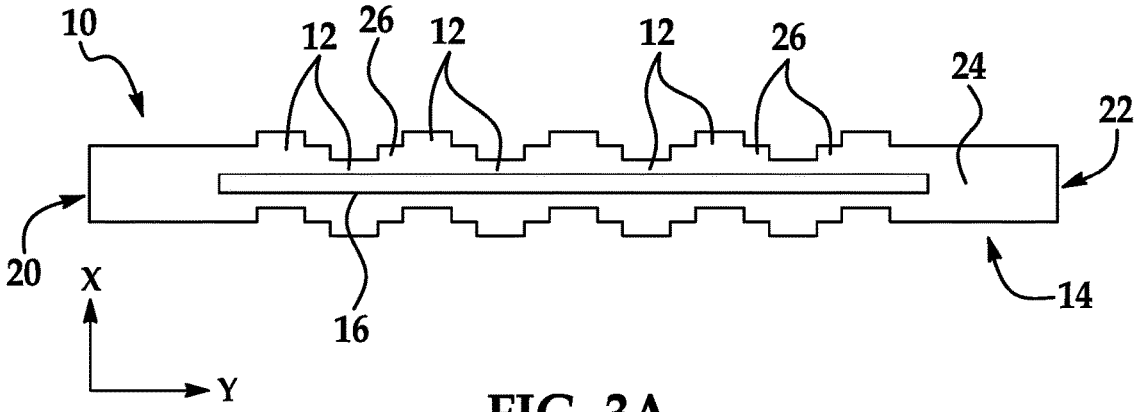
FIGS. 3A and 3B are side and perspective views of a parallel-plate fed (single-sided) basic shifted waveguide section Feed.
Figure 3B:
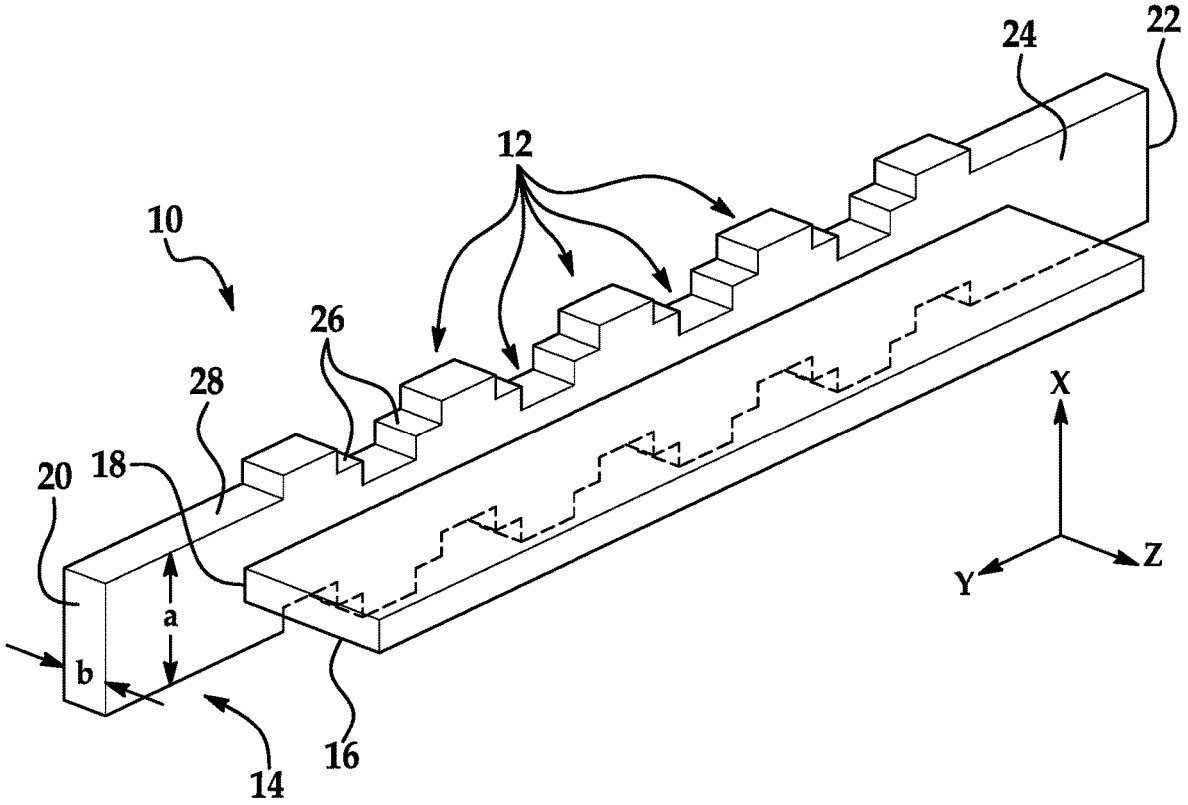

Referring now to FIGS. 3A and 3B, illustrated are side and perspective views of an exemplary waveguide coupler 10 in accordance with a first embodiment of the present invention. The basic design employs identical-length shifted waveguide sections 12 down the length of a rectangular waveguide 14. As used herein, a "shifted waveguide section" refers to at least one step change (ascending or descending) in a sidewall of the waveguide resulting in a shift of the waveguide centerline in that section that is approximately ¼ wavelength in length. As seen in FIGS. 3A and 3B, alternating ¼-wave shifted waveguide sections 12 excite/couple rectangular waveguide fields into a parallel-plate 16 via a slot/fin 18 extending from the center of the broadwall of the rectangular waveguide 14.

The rectangular waveguide 14 includes a first input/output (I/O) port 20 and a second I/O port 22, wherein one or both of the first and second I/O ports may receive RF signals. As will be described in more detail below, in one embodiment one I/O port is configured to receive an RF signal and the other I/O port is configured to absorb (attenuate) the RF signal, i.e., it acts as a load. In another embodiment both I/O ports receive an RF signal, and in yet another embodiment both I/O ports are configured as electrical short circuits.

The slot 18 is formed in a first broadwall 24 of the waveguide 14 between the first and second I/O ports 20, 22. The slot 18, which preferably is centered on the first broadwall 24, is approximately equal in length and width and coupled to the parallel-plate transmission line 16, which receives and/or provides RF signals from/to the waveguide 14. Between the shifted waveguide sections 12 are a plurality of unshifted waveguide sections 26 arranged between the first and second I/O ports 20, 22 and extend along a length of the waveguide 14.

Alternating shifted waveguide sections 12 are of equal step length, and can be formed by stepping each sidewall 28. In the embodiment of FIGS. 3A-3B, the shifted waveguide sections 12 are complementary to each other, i.e., the equal steps in the same direction relative to the waveguide 14 centerline effectively shift the waveguide centerline in the shifted waveguide section. This results in a waveguide a-dimension and b-dimension of the shifted waveguide sections as being the same as the a-dimension and b-dimension of the unshifted waveguide sections but with their centerlines offset from one another. As shown in FIGS. 3A-3B, each shifted waveguide section includes an alternating arrangement of ascending or descending steps that approximate a sinusoidal profile in the waveguide coupler.

In the embodiment shown in FIGS. 3A and 3B, each shifted waveguide section 12 includes a step having a step width and a step height, and each step of the plurality of shifted waveguide sections has the same step width and step height as other steps of the plurality of shifted waveguide sections. In another embodiment, at least one step of the plurality of shifted waveguide sections has a different step width or step height from other steps of the plurality of shifted waveguide sections. The dimensions of each step can be configured to provide a desired characteristic. For example, a first step width may correspond to a quarter wavelength of an RF signal at one particular operating frequency propagating through the waveguide and a second step width may correspond to a quarter wavelength of the RF signal at a second particular operating frequency to provide a desired coupling characteristic between the waveguide and the parallel-plate transmission line (e.g., the reflections at each step will cancel out, each at slightly different frequencies).

When compared to the closest "relative" (e.g., a traveling-wave fed waveguide employing series-series/angle-slots or shunt-series offset slots), the device in accordance with the present invention is better-suited for injection molding. This is due at least in part to the use of a continuous centered slot (coupling from the waveguide centerline to the parallel-plate) together with sidewall shifted waveguide sections or "meander" features, which can be realized in a simple two-piece mold. In other words, internal details or resonant slots are not required, thereby simplifying the mold. Additionally, high-Q resonant structures are not present, which results in wider operating frequency bandwidth (unlike the behavior of typical resonant coupling structures, the equivalent slot conductance "G" of the device and method according to the invention is largely frequency independent). Further, the device and method in accordance with the invention provide superior tolerance insensitivity as compared to "conventional" high-Q structures. This provides high-performance even at millimeter wave (MMW) frequencies (through 94 GHz) using conventional injection-molding techniques.

Also, superior bandwidth performance of the device and method in accordance with the invention enables traveling-wave implementations with "radiating load" (e.g., the last coupling unshifted waveguide section(s) is/are employed as a termination load for the traveling-wave feed, thereby eliminating the need for a conventional load, and eliminating the associated efficiency loss). The bilateral and balanced nature of the coupling mechanism also allows for both one-sided (launch in one parallel-plate direction) and two-sided (launch in two opposing parallel-plate directions) implementations.

Figure 4A:
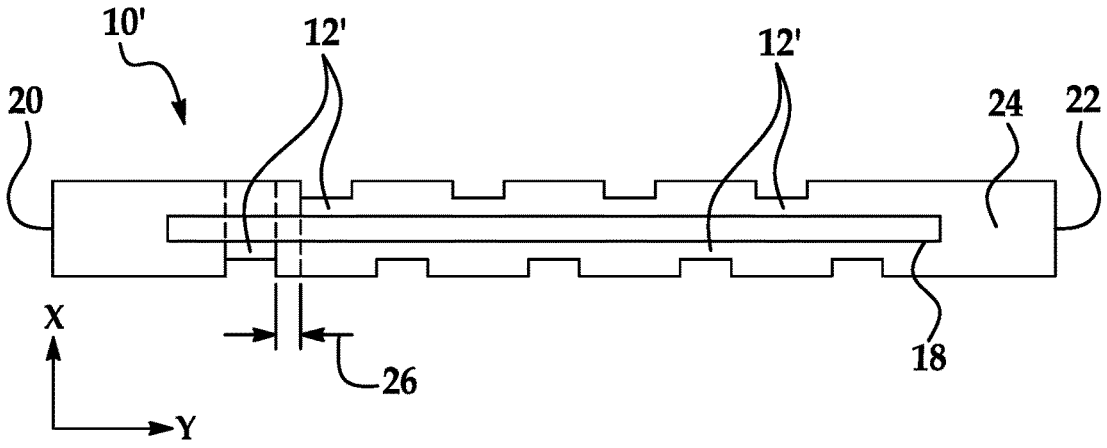
FIGS. 4A and 4B are side and perspective views of a modified shifted waveguide section variant with dissimilar length blocks on opposing sides of the rectangular waveguide.
Figure 4B:
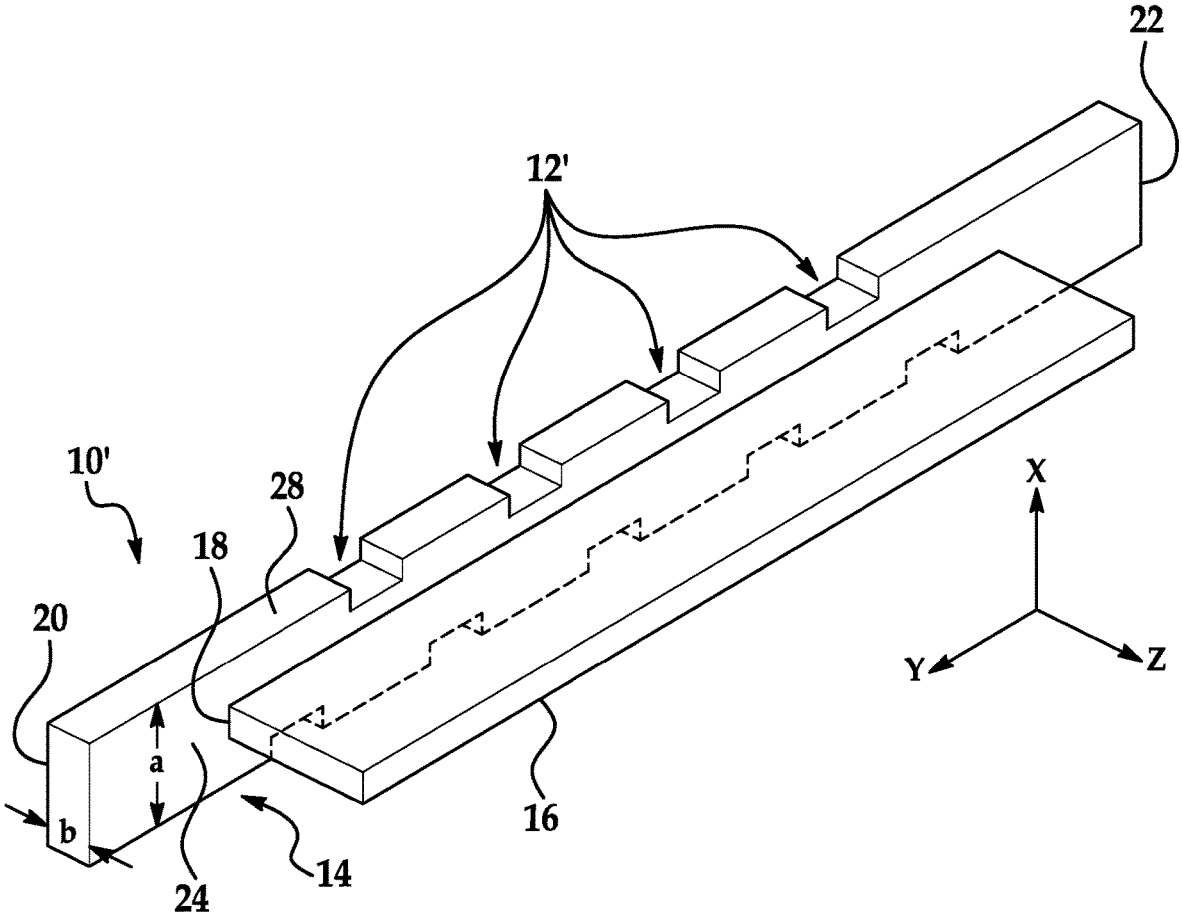

In a variant of the basic design, referred to as the "Modified Offset Block (MOSB)" feed 10' (or modified shifted waveguide feed) and shown in FIGS. 4A-4B, the abrupt steps (of equal length on both opposing sides of the waveguide) are replaced by a single step on just one side of the waveguide to form each alternating shifted waveguide section, thereby creating the discretized "meandering" of the waveguide centerline on either side of the centered broadwall slot (or "fin", which is applicable in cases where a dielectric medium is a solid material instead of air) between unshifted waveguide sections 26. In this embodiment the single-step shifted waveguide sections maximize the operating bandwidth of the MOSB structure despite having a smaller a-dimension as compared to the unshifted waveguide sections. The MOSB has generally wider bandwidth characteristics as compared to the OSB, based on the reduction of the "abrupt" waveguide section offset steps, thereby removing one of the resonant (bandwidth-limiting) characteristics. The equivalent circuits for both variants are similar.

As illustrated in FIGS. 4A and 4B, the waveguide coupler 10' is similar to that shown in FIGS. 3A-3B, with the exception of the arrangement of the shifted waveguide sections 12', where only a single sidewall step is employed to achieve the shifting of the waveguide centerline in the shifted waveguide sections. As can be seen in FIGS. 4A-4B, between the shifted waveguide sections 12' are a plurality of unshifted waveguide sections 26 arranged between the first and second I/O ports 20, 22 and extend along a length of the waveguide 14. In contrast to the waveguide coupler 10 of FIGS. 3A-3B, a cross section of the waveguide coupler 10' through sidewalls of the waveguide 14 is not constant and instead varies along a length of the waveguide. This variant provides similar microwave characteristics to the basic (identical section length) but has the mechanical advantage of allowing for a narrower overall cross-section.

In terms of design limitations for the embodiment of FIGS. 4A and 4B, care should be taken to limit the "b" dimension of the (M)OSB waveguide in order to limit the waveguide to single indices (transverse only) waveguide modes. Further, the maximum offset together with the waveguide "a" dimension should be limited in order to ensure (pre)dominant TE10 waveguide propagation (though TE20 is strongly excited as an evanescent component.) Also, the "b" dimension of the centered continuous coupling slot should also be constrained in order to minimize undesired higher-order (evanescent) mode coupling from the waveguide to the parallel-plate region. As used herein, the "a" dimension refers to the longer dimension of the waveguide cross-section (the broadwall height) and the "b" dimension refers to the shorter dimension of the waveguide cross-section (the sidewall).

Figure 5A:
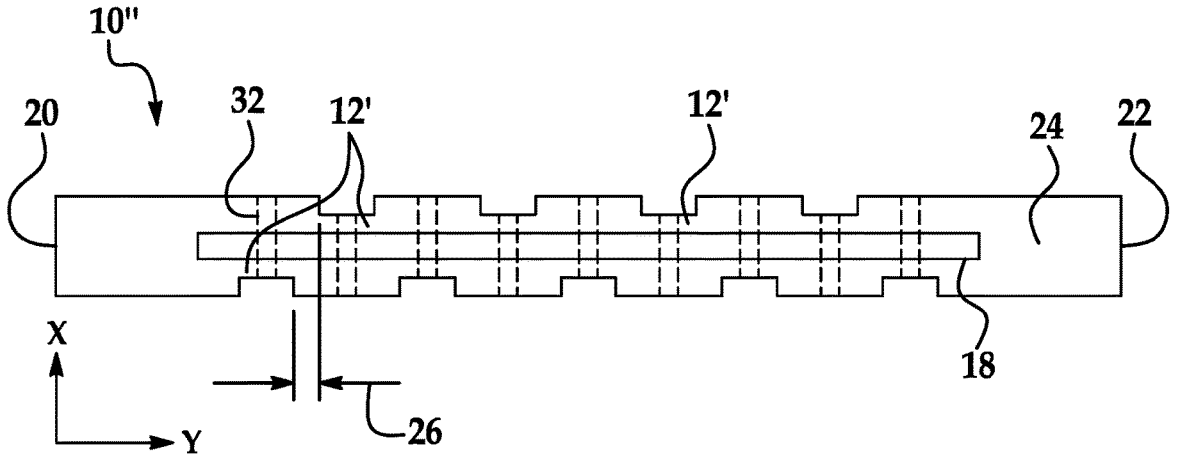
FIGS. 5A and 5B are side and perspective views of a modified shifted waveguide section variant with added broadwall tuners in order to "match" $|S11|=0$ (useful for efficient broadside operation with traveling-wave designs.)
Figure 5B:
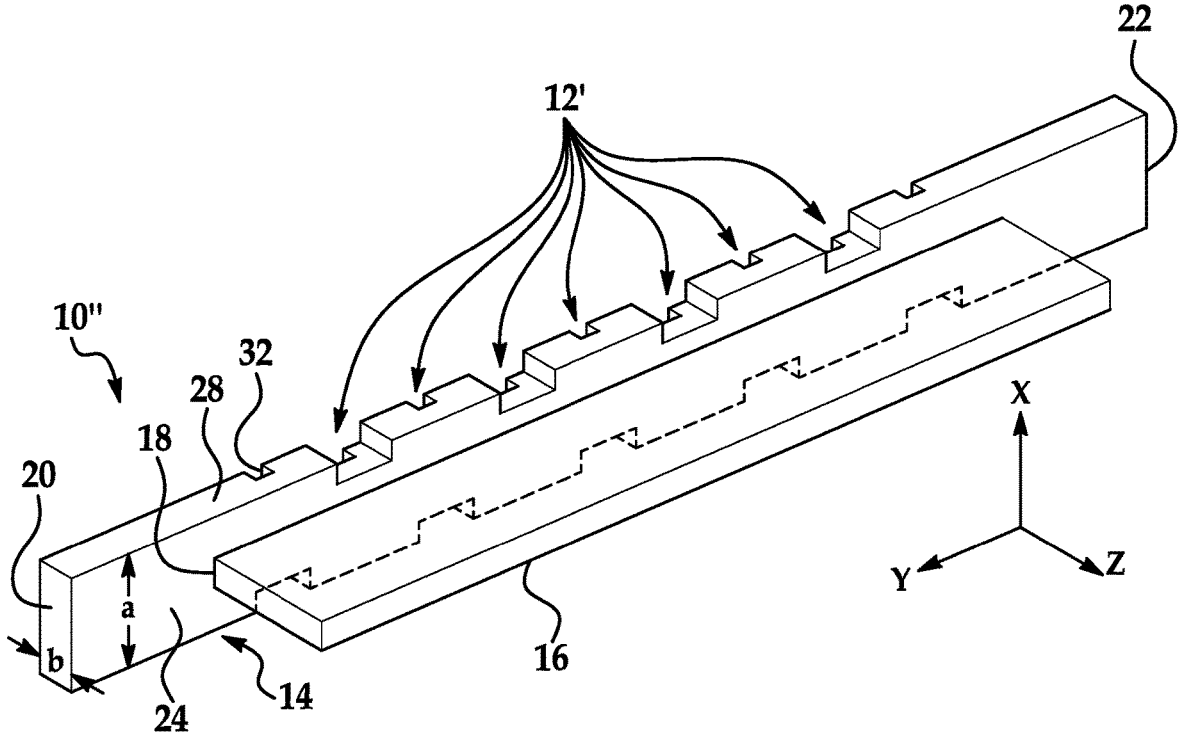
Figure 6:
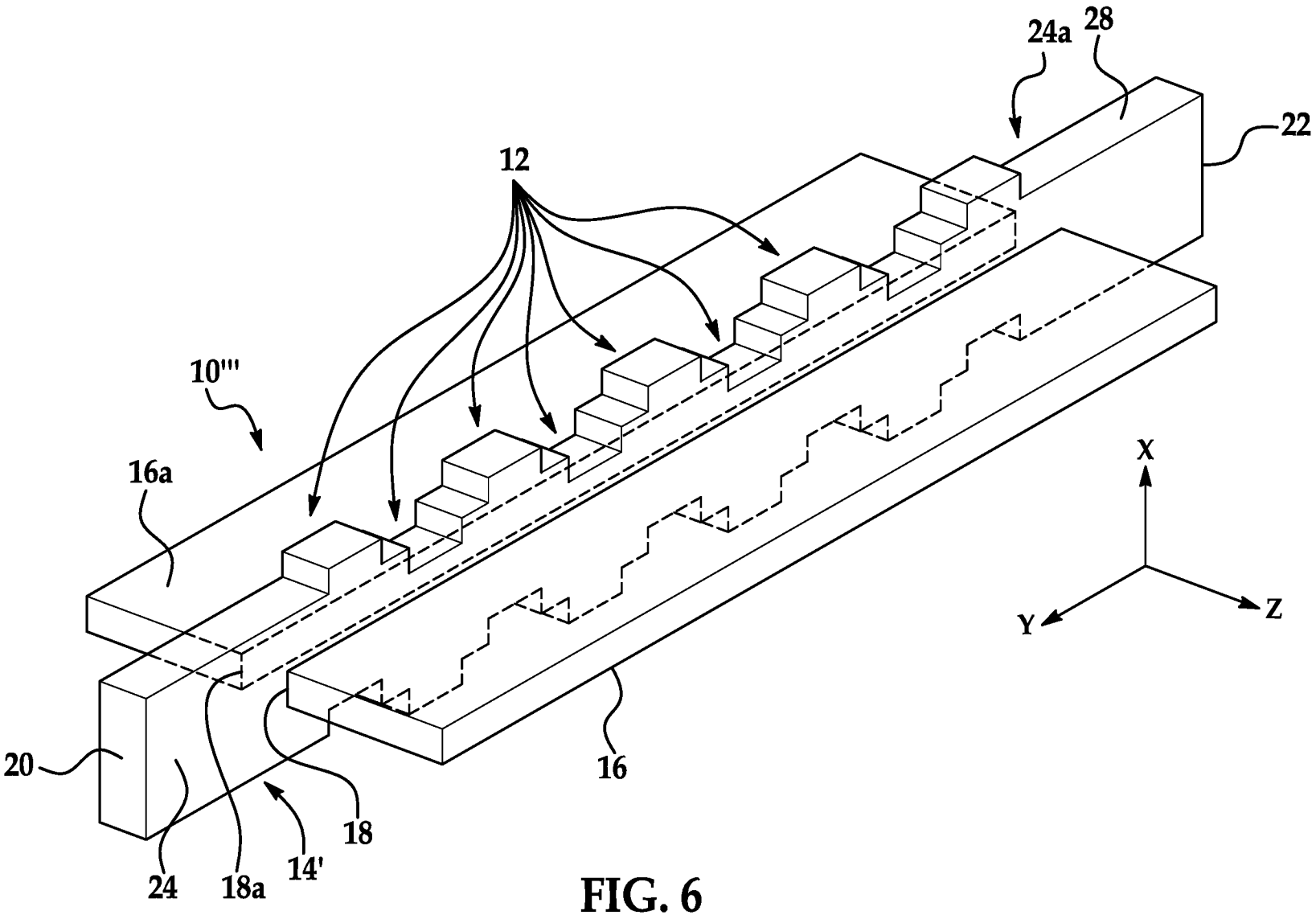
FIG. 6 is a perspective view of a basic or modified shifted waveguide section with dual-sided parallel-plate coupling into two opposing parallel-plate regions via two slots in the two opposing rectangular waveguide broadwalls.

Moving now to FIGS. 5A-5B, illustrated is a waveguide coupler 10" in accordance with another embodiment of the invention. The embodiment of FIGS. 5A-5B is similar to the embodiment of FIGS. 4A-4B, but includes tuner features 32 formed in at least one of the first (front) broadwall or a second (rear/opposing) broadwall of the waveguide 14. The broadwall tuner features, which in the exemplary embodiment are formed as rectangular grooves formed in a broadwall and spanning between opposing sidewalls, are configured to "match" $|S11|=0$. This is useful for efficient broadside operation with traveling-wave designs wherein the undesirable peak in input reflection coefficient (due to coherent addition of the reflections of individual elements) is largely mitigated. The tuner features 32 can be formed in portions of the broadwall 24 and/or sidewall 28 that do not include a shifted waveguide section 12', or they can at least partially be formed in a shifted waveguide section 12', as can be seen in FIG. 5B. Alternative embodiments may employ tuner features having semicircular features instead of rectangular grooves Referring now to FIG. 6, illustrated is a dual-sided waveguide coupler 10'" coupling into two opposing parallel-plate transmission lines 16, 16*a* in accordance with another embodiment of the invention. The embodiment of FIG. 6 is similar to the embodiment of FIGS. 3A and 3B but includes a second slot 18*a* formed in the second (opposing) broadwall 24*a* of the waveguide 14'. The second parallel-plate transmission line 16*a* is coupled to the second slot 18*a* to communicate RF signals between the waveguide 14' and the parallel plate transmission line 16*a*. The embodiment of FIG. 6 is advantageous in that signals from the waveguide 14' can be selectively split into one of the two transmission line structures 16, 16*a* and/or received from each of the transmission line structures and combined in the waveguide 14'.

Figure 7A:
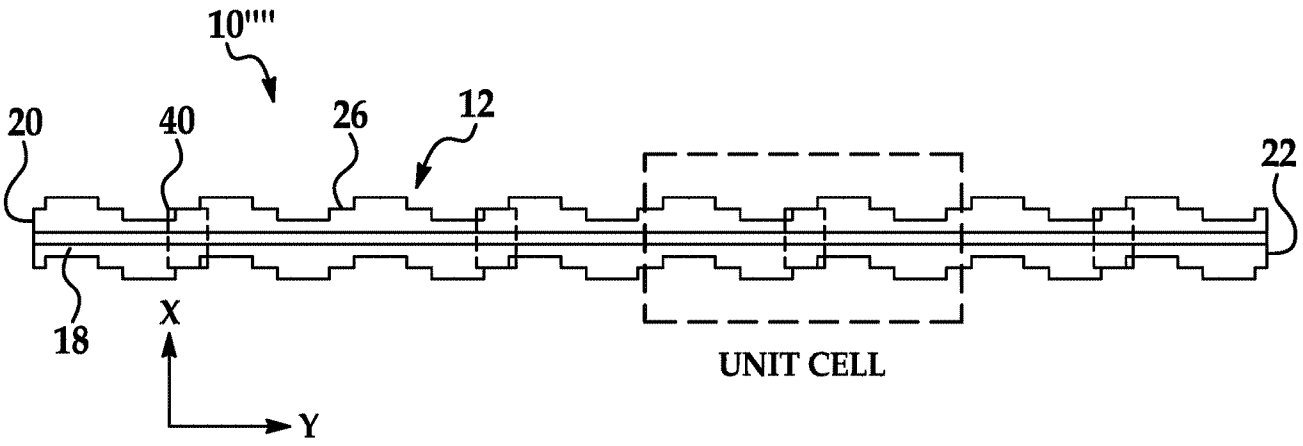
FIG. 7A-7B are side and perspective views of a basic (or modified) (M)OSB variant realized as an "N-Element" standing-wave feed and fed via individual discrete waveguide ports connecting the broadwall of the waveguide opposite the broadwall coupling to the parallel-plate.
Figure 7B:
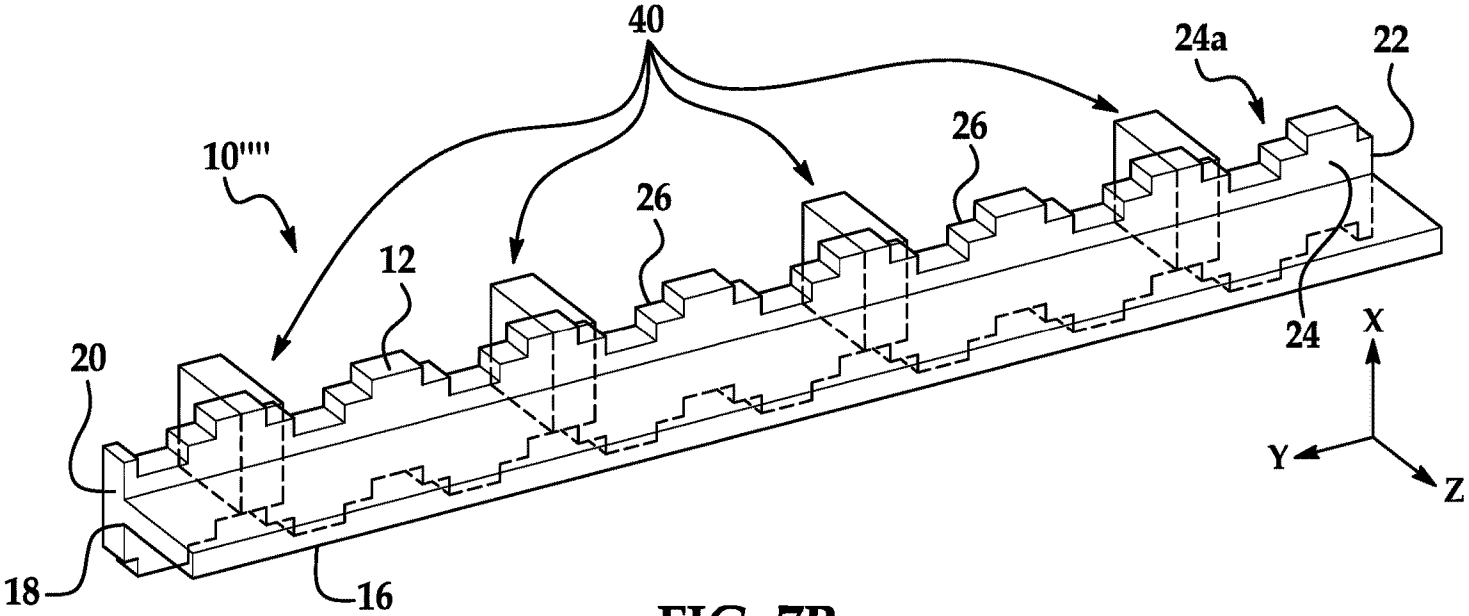

Moving to FIGS. 7A and 7B, illustrated is a waveguide coupler 10"" in accordance with another embodiment of the invention. The waveguide coupler 10'" is similar to the waveguide coupler 10 of FIGS. 3A and 3B, but is realized as an "N-Element" standing-wave feed and fed via a plurality of individual discrete rectangular waveguide ports 40 connected to the rear broadwall 24*a* (i.e., the broadwall opposite the broadwall 24 coupled to the parallel-plate transmission line 16). As seen in FIGS. 7A and 7B, at least one shifted waveguide section 12 of the plurality of shifted waveguide sections is arranged between adjacent input waveguides 40. Further, each I/O port 20, 22 includes an electrical short circuit between opposing sidewalls. The short circuit may be formed, for example, by including a metal conductor or the like connecting the opposing sidewalls. Due to boundary conditions imposed on opposing waveguide signals, virtual short-circuits are naturally realized at the boundaries between opposing waveguide fed sections. As a signal enters the waveguide coupler 10'" from waveguide ports 40, it splits in in both directions and travels along the waveguide, where it resonates between the short circuit at one port and the virtual short (or between virtual shorts—see the unit cell in FIG. 7A) before exiting via the slot and into the parallel-plate transmission line 16.

The waveguide couplers described herein can be realized as an air-filled, or more typically, a single dielectric-filled waveguide structure. This reduces the size/thickness of the assembly and further simplifies low-cost injection-molding as an integrated structure (one-piece fabrication including OSB feed and radiating CTS structure). In the air-filled embodiment, the waveguide may be formed from a plastic or like material to define the respective portions of the waveguide coupler, and a metallized surface can be formed on or in the plastic material. In the dielectric embodiment, a metalized surface can be formed over the dielectric material. Also, the structures can be terminated in a conventional load or a traveling-wave fed structure can be terminated in a "coupling/zero-loss" load, where the last coupling element(s) are employed as a "radiating" load thereby eliminating the undesired loss associated with conventional absorptive loads.

The device and method in accordance with the invention departs from the conventional methods described herein by coupling the propagating energy inside the rectangular waveguide through a long centered narrow slot on its broadwall where it is transitioned into the parallel-plate (see FIG. 3A). This is an improved derivative of the conventional longitudinal offset slot waveguide feed employing an array of discrete (resonant) slots.

Potential benefitting applications include (but are not limited to) Continuous Transverse Stubs (CTS) and Variable Inclination Continuous Transverse Stub (VICTS) antennas or any other microwave device employing parallel-plate transmission line structure(s.)

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

What is claimed is:

1. A waveguide coupler, comprising:

a waveguide including i) a first and a second port;

ii) a first slot formed in a first broadwall of the waveguide between the first and second ports, the first slot centered on the first broadwall;

iii) a plurality of shifted waveguide sections arranged between the first and second ports and extending along a length of the waveguide; and a first parallel-plate transmission line structure coupled to the first slot, wherein RF signals within one of the waveguide or the parallel-plate transmission line are communicated to the other of the waveguide or the parallel-plate transmission line through the slot.

2. The waveguide coupler according to claim 1, wherein each shifted waveguide section includes an alternating arrangement of ascending or descending steps.

3. The waveguide coupler according to claim 2, wherein the alternating arrangement of ascending or descending steps is formed at least partially on sidewalls of the waveguide, and each step on a first sidewall of the waveguide is offset along a length of the waveguide from a step on a second sidewall of the waveguide, the second sidewall opposite the first sidewall.

4. The waveguide coupler according to claim 1, wherein each shifted waveguide section comprises at least one step having a step width and a step height, and each step of the plurality of shifted waveguide sections has the same step width and step height as other steps of the plurality of shifted waveguide sections.

5. The waveguide coupler according to claim 1, wherein each shifted waveguide section comprises at least one step having a step width and a step height, and at least one step of the plurality of shifted waveguide sections has a different step width or step height from other steps of the plurality of shifted waveguide sections.

6. The waveguide coupler according to claim 4, wherein the step width corresponds to a quarter wavelength of an RF signal propagating through the waveguide.

7. The waveguide coupler according to claim 1, wherein the waveguide a-dimension of the waveguide coupler is constant throughout.

8. The waveguide coupler according to claim 1, wherein the plurality of shifted waveguide sections approximate a sinusoidal profile in the waveguide coupler.

9. The waveguide coupler according to claim 1, wherein the waveguide a-dimension of the waveguide coupler varies.

10. The waveguide coupler according to claim 1, wherein the second port comprises a load that attenuates an RF signal propagating in the waveguide.

11. The waveguide coupler according to claim 1, wherein the second port comprises a short that electrically connects the first sidewall to the second sidewall.

12. The waveguide coupler according to claim 1, wherein the waveguide coupler comprises a dielectric material.

13. The waveguide coupler according to claim 12, wherein the dielectric material comprises one of a solid dielectric or an air dielectric.

14. The waveguide coupler according to claim 1, further comprising a plurality of tuner features formed in at least one of the first broadwall or a second broadwall of the waveguide.

15. The waveguide coupler according to claim 14, wherein the tuner features are at least partially formed in at least one of the shifted waveguide sections.

16. The waveguide coupler according to claim 1, further comprising a second slot formed a second broadwall of the waveguide, the second broadwall arranged opposite the first broadwall.

17. The waveguide coupler according to claim 16, further comprising a second parallel-plate transmission line structure coupled to the second slot to communicate RF signals between the waveguide and the parallel plate transmission line.

18. The waveguide coupler according to claim 1, wherein each port comprises an electrical short circuit, further comprising a plurality of input waveguides coupled to a second broadwall of the waveguide, wherein at least one shifted waveguide section of the plurality of shifted waveguide sections is arranged between adjacent input waveguides.

19. The waveguide coupler according to claim 18, wherein virtual shorts are formed at boundaries between adjacent input waveguides.

20. A method of launching a desired uniform or non-uniform Radio Frequency (RF) field-distribution from a waveguide into an open parallel-plate transmission line structure, wherein the waveguide is coupled to the parallel-plate transmission line via a continuous slot centered in a broadwall of the waveguide, the method comprising using shifted waveguide sections in the waveguide to perturb the RF field distribution in such a way as to couple RF energy via the continuous slot in order to create a desired e-field distribution in the parallel-plate section.

* * * * *